US011460236B2

(12) United States Patent
Yu et al.

(10) Patent No.: US 11,460,236 B2
(45) Date of Patent: Oct. 4, 2022

(54) REFRIGERATOR STORAGE COMPARTMENT

(71) Applicant: LG ELECTRONICS INC., Seoul (KR)

(72) Inventors: Seonil Yu, Seoul (KR); Daesung Lee, Seoul (KR); Junyi Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 401 days.

(21) Appl. No.: 16/685,347

(22) Filed: Nov. 15, 2019

(65) Prior Publication Data

US 2020/0208902 A1 Jul. 2, 2020

(30) Foreign Application Priority Data

Dec. 26, 2018 (KR) ..... 10-2018-0169259

(51) Int. Cl.
*F25D 23/02* (2006.01)
*F25D 11/02* (2006.01)
*F25D 23/04* (2006.01)

(52) U.S. Cl.
CPC ..... *F25D 23/025* (2013.01); *F25D 11/02* (2013.01); *F25D 23/028* (2013.01); *F25D 23/04* (2013.01); *F25D 2323/023* (2013.01)

(58) Field of Classification Search
CPC ..... F25D 23/025; F25D 23/028; F25D 23/04; F25D 2323/023
USPC ..... 62/441
See application file for complete search history.

(56) References Cited

U.S. PATENT DOCUMENTS

2013/0033163 A1* 2/2013 Kang ..... F25D 23/04 312/405.1

FOREIGN PATENT DOCUMENTS

| | | | |
|---|---|---|---|
| CN | 1548891 | A | 11/2004 |
| CN | 102230713 | A | 11/2011 |
| CN | 102422104 | A | 4/2012 |
| CN | 102422105 | A | 4/2012 |
| CN | 103185432 | A | 7/2013 |
| CN | 103477170 | A | 12/2013 |
| CN | 107588586 | A | 1/2018 |
| EP | 3333519 | A1 | 6/2018 |
| KR | 10-2008-0003647 | A | 1/2008 |
| WO | 2013/022198 | A1 | 2/2013 |
| WO | 2014/200317 | A1 | 12/2014 |

* cited by examiner

*Primary Examiner* — Steve S Tanenbaum
(74) *Attorney, Agent, or Firm* — Dentons US LLP

(57) ABSTRACT

A refrigerator having a first storage compartment with a first storage space defined therein; an inner door to open and close the first storage space, wherein the inner door has an inner door receiving space that is separate from the first storage space; a receiving casing attached to a back face of the inner door; and an outer door pivotally mounted to the inner door to open and close the inner door receiving space, wherein the receiving casing includes a frame surrounding the inner door receiving space, wherein the frame has a cold-air hole defined therein, and a transparent plate attached to the frame to separate the inner door receiving space from the first storage space.

14 Claims, 8 Drawing Sheets

REFRIGERATOR STORAGE COMPARTMENT

CROSS-REFERENCE TO RELATED APPLICATION

This application claims the benefit of priority to Korean Patent Application No. 10-2018-0169259, filed on Dec. 26, 2018, with the Korean Intellectual Property Office, the entire contents of which is incorporated herein by reference.

BACKGROUND

1. Field

The present disclosure relates to a refrigerator, and more particularly to a refrigerator having more than one storage space.

2. Description of Related Art

A refrigerator is an apparatus for freezing or refrigerating and storing food and the like by maintaining a temperature of a storage compartment disposed in the refrigerator at a predetermined temperature using a freezing cycle composed of a compressor, a condenser, an expansion valve, and an evaporator. In general, the refrigerator includes a freezing compartment for freezing and storing food or beverages and a refrigerating compartment for storing the food or beverages at low temperatures.

Refrigerators are distinguished based on locations of the freezing compartment and the refrigerating compartment. For example, the refrigerators may be divided into a top mount type with the freezing compartment located above the refrigerating compartment, a bottom freezer type with the freezing compartment located below the refrigerating compartment, and a side by side type with the freezing compartment and refrigerating compartment divided left and right by a partition.

Recently, due to consumer demand, temperatures of the refrigerating compartments and the freezing compartment are able to be freely adjusted based on the food stored therein. Refrigerators that allows uses of a larger refrigerating compartment by allowing the freezing compartment to have the same temperature as the refrigerating compartment have been proposed and used.

Further, a food storage duration may vary depending on a type, processing and packaging conditions of the food. Recently, a refrigerator is being used to properly store items such as cosmetics or wine.

Refrigerators are gradually becoming larger and more versatile in accordance with change of dietary life and upgraded products. Refrigerators with various structures and convenience devices are being released to enable users' convenience and efficient use of an internal space.

The storage space of the refrigerator may be opened and closed by a door. The refrigerator may be classified into various types of refrigerators according to the arrangement of the storage spaces and the structures of the doors that opens and closes the storage spaces.

The doors of the refrigerator may include an inner door including a separate receiving space (for example, a "home bar") accessible from an outside, and outer doors pivotally coupled to the inner door to open and close the receiving space of the inner door. The outer doors may open the receiving space of the inner door. Then, the user may access the receiving space of the inner door by opening some outer doors without opening all of the outer doors.

Further, to distinguish the receiving space of the inner door from the storage space of the refrigerator and to prevent cold air from the storage space of the refrigerator from leaking out of the refrigerator through the receiving space of the inner door when opening the outer door, a separate receiving casing covering the receiving space of the inner door may be disposed inwardly from the inner door, that is, toward the storage space of the refrigerator.

In this case, the receiving casing disposed in the receiving space of the inner door is usually formed by assembling a plurality of injection molded pieces which are made of a transparent or translucent material. Thus, the receiving casing essentially has a die fitting line which is essentially formed during the injection molding of the receiving casing, and a fastening line formed in assembling of the plurality of injection molded pieces, thereby causing a problem that the receiving casing is not visually appealing to consumers.

SUMMARY

The present disclosure solves the above-mentioned problems.

One purpose of the present disclosure is to provide a refrigerator having an improved receiving space structure disposed in a door of the refrigerator.

Another purpose of the present disclosure is to provide a refrigerator having an improved receiving casing that defines a receiving space disposed in an inner door of the refrigerator.

Another purpose of the present disclosure is to provide a refrigerator having an improved assembly structure of a receiving casing defining a receiving space disposed in an inner door of the refrigerator to improve assembly efficiency thereof.

It is understood that purposes of the present disclosure are not limited to the above-mentioned purpose. Other purposes and advantages of the present disclosure may be understood from the following descriptions and more clearly understood from embodiments of the present disclosure. Further, it will be readily appreciated that the purposes and advantages of the present disclosure may be realized by features and combinations thereof as disclosed in the claims.

One object of the present disclosure proposes a refrigerator comprising: a first storage compartment having a first storage space defined therein; an inner door to open and close the first storage space, wherein the inner door has a receiving space defined therein distinct from the first storage space; a receiving casing mounted on a back face of the inner door to separate the first storage space from the receiving space; and an outer door pivotally mounted to the inner door to open and close the receiving space, wherein the receiving casing includes: a frame surrounding the receiving space, wherein the frame has a cold-air hole defined therein through which cold air from the first storage space is introduced into the receiving space; and a transparent plate attached to the frame to separate the receiving space from the first storage space.

In one implementation, the frame includes: both lateral frames arranged in a symmetrical manner, wherein the receiving space is defined between the both lateral frames; a top frame coupled to a top of each of the lateral frames, wherein the cold-air hole is defined in the top frame; and a bottom frame coupled to a bottom of each of the lateral frames.

In one implementation, each of the lateral frames includes: an outer plate defining an outer face of the lateral frame; and an inner plate coupled to the outer plate to define an inner face of the lateral frame.

In one implementation, the outer plate has a spacing rib to define a spacing between the inner plate and the outer plate.

In one implementation, a hollow space for thermal insulation is defined between the outer plate and the inner plate.

In one implementation, an end of the inner plate extends beyond a corresponding end of the outer plate to be attached to the transparent plate.

In one implementation, the upper frame has inserted protrusions protruding downwardly from both ends of a bottom face thereof to be inserted into the both lateral frames respectively.

In one implementation, the upper frame has an adhered portion protruding from a bottom face thereof to be attached to the transparent plate.

In one implementation, the lower frame has a lower plate fixedly supporting the lateral frames thereon.

In one implementation, the lower frame further includes a thermal insulating portion disposed on the lower plate and disposed between the lateral frames.

In one implementation, a coating layer is disposed on the transparent plate along an outer perimeter thereof to prevent exposure of an adhesive member for attaching the transparent plate to the frame to an outside.

In one implementation, the refrigerator further comprises a second storage compartment below the first storage compartment, wherein the second storage compartment has a second storage space having defined therein and operates independently of the first storage compartment.

In one implementation, the second storage compartment includes at least one drawer to extend from the second storage space to open the second storage space.

In one implementation, the outer door further includes: a manipulator for controlling the first storage compartment and the second storage compartment; and a display for indicating an operation state of the first storage compartment and the second storage compartment.

Effects of the present disclosure are as follows but are not limited thereto.

According to the refrigerator according to the present disclosure, the structure of the receiving space placed in the door of the refrigerator may be improved.

Further, according to the refrigerator according to the present disclosure, the receiving casing that defines the receiving space disposed in the inner door of the refrigerator may be improved to improve aesthetics thereof.

Furthermore, according to the refrigerator according to the present disclosure, an assembly structure of the receiving casing defining the receiving space disposed in the inner door of the refrigerator is improved to improve assembly efficiency thereof.

BRIEF DESCRIPTION OF THE DRAWINGS

The accompanying drawings constitute a part of this specification and illustrate an embodiment of the present disclosure and together with the specification, explain the present disclosure.

DETAILED DESCRIPTION

Figure 1:
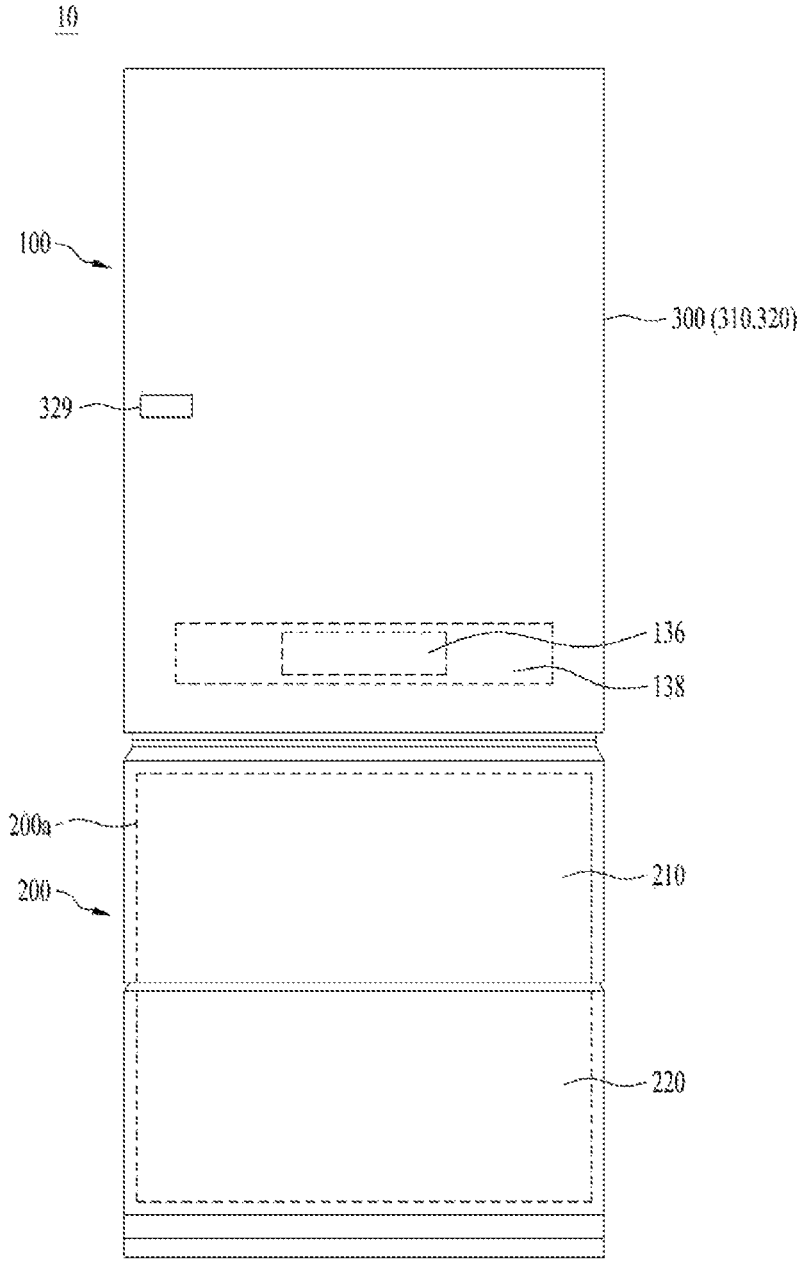
FIG. 1 is a front view of a refrigerator according to an embodiment of the present disclosure.

For simplicity and clarity of illustration, elements in the figures are not necessarily drawn to scale. The same reference numbers in different figures denote the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In describing the components of the embodiment(s) of the present disclosure, terms such as first, second, A, B, (a), and (b) may be used. These terms are only for distinguishing the components from other components, and the nature, order or order of the components are not limited by the terms. If a component is described as being "connected", "coupled" or "connected" to another component, it should be understood that the component may be directly connected or connected to that other component, but having other components there between.

First, the refrigerator according to one embodiment of the present disclosure will be described in detail with reference to the accompanying drawings.

Figure 2:
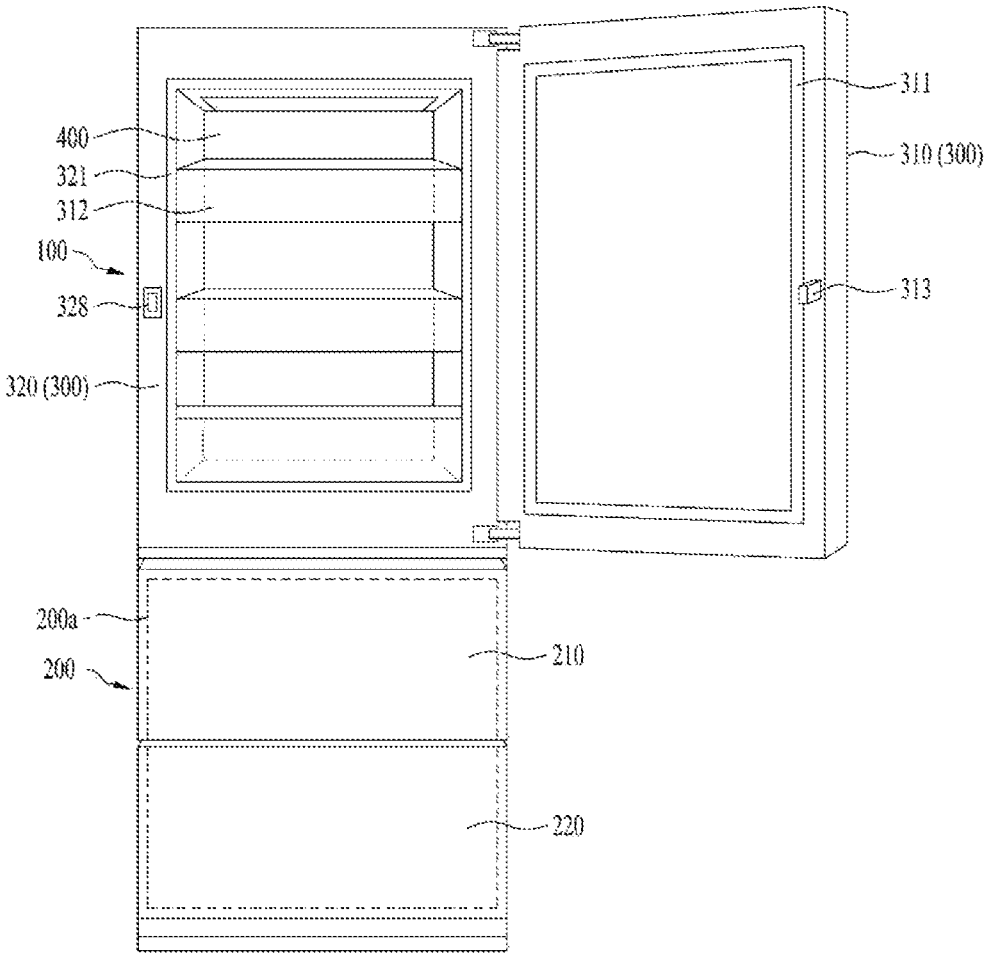
FIG. 2 is a front view illustrating a state in which an outer door of a refrigerator is open according to an embodiment of the present disclosure.
Figure 3:
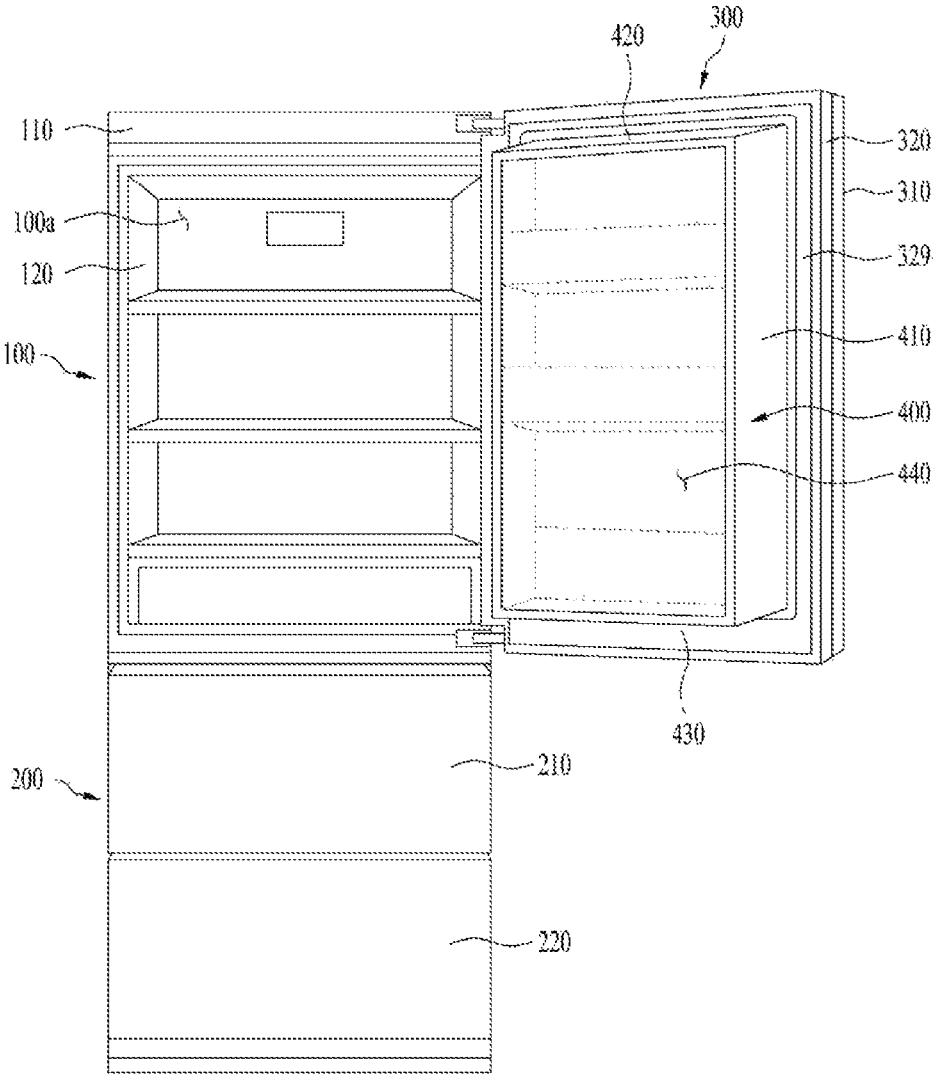
FIG. 3 shows a front view illustrating a state in which an inner door of a refrigerator is open according to an embodiment of the present disclosure.
Figure 4:
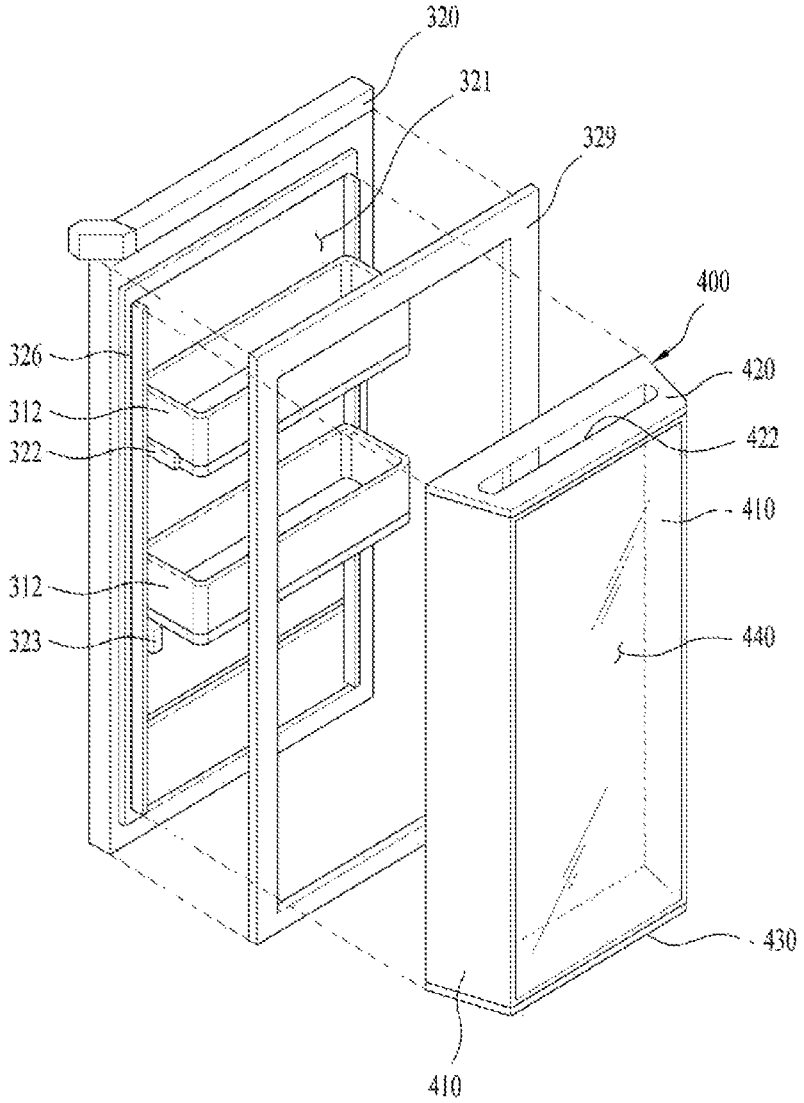
FIG. 4 is an exploded perspective view showing an inner door of a refrigerator according to an embodiment of the present disclosure.

FIG. 1 is a front view of a refrigerator according to an embodiment of the present disclosure. FIG. 2 is a front view illustrating a state in which an outer door of a refrigerator is open according to an embodiment of the present disclosure. FIG. 3 shows a front view illustrating a state in which an inner door of a refrigerator is open according to an embodiment of the present disclosure.

As shown in FIGS. 1 to 3, a refrigerator 10 may be formed in a substantially rectangular parallelepiped shape with an open front face. The shape is not limited thereto. The refrigerator 10 may include a first storage compartment 100 disposed at an upper portion of the refrigerator 10 to define a first storage space 100*a* therein and a second storage compartment 200 disposed below the first storage compartment 100 to define therein a second storage space 200*a*, which is opened and closed in a form of a drawer. The upper portion of the refrigerator 10 is relative to the ground and above a lower portion of the refrigerator 10.

In this embodiment, the first storage space 100*a* or the second storage space 200*a*, which is a storage space for storing food or other items therein, may be selectively disposed as a refrigerating compartment or a freezing compartment. In the present embodiment, for convenience purposes, it is described that the first storage space 100*a* and the second storage space 200*a* are used as the refrigerating compartments, but they are not limited to the refrigerating compartments.

Depending on a type or a temperature of food or other items to be stored in the first storage space 100*a* or in the second storage space 200*a*, the first storage space 100*a* and the second storage space 200*a* may be selectively used as the refrigerating compartment/freezing compartment or the freezing compartment/refrigerating compartment, respectively. Alternatively, both the first storage space 100*a* and the second storage space 200*a* may be used as the refrigerating compartments or the freezing compartments.

The second storage compartment 200 may be located below the first storage compartment 100 and may have one or more drawers 210 and 220 in a form of being extendable forward from (in a direction extending outside of) the refrigerator 10. The second storage space 200*a*, where food or other items may be stored, may be exposed by the extension of the drawers 210 and 220. The second storage space 200*a* may be divided by the plurality of drawers 210 and 220.

According to an embodiment of the invention, a refrigerating cycle apparatus (not shown) for adjusting temperatures of the first storage space 100*a* and the second storage space 200*a* may be disposed inside the refrigerator 10, in a separate space separated from the first storage space 100*a* and the second storage space 200*a*.

In this embodiment, for example, the refrigerating cycle apparatus may have a refrigerant cycle composed of a compressor, a condenser, an expander, and an evaporator and a flow path for supplying the cold air into the first storage space 100*a* and the second storage space 200*a*. The position and configuration of the refrigerating cycle apparatus may vary according to design preferences. A detailed description thereof will be omitted.

As shown, the second storage compartment 200 may be located below the first storage compartment 100 and may be used as a refrigerating compartment or freezing compartment independently of the first storage compartment 100. The second storage compartment 200 may have at least one drawer 210 and 220 to open a second storage space 200*a* of the second storage compartment 200 and at the same time to form a storage space for food or other items.

In this embodiment, the drawer 210 and 220 may include an upper drawer 210 defining an upper front face of the second storage compartment 200 and a lower drawer 220 defining a lower front face of the second storage compartment 200. The upper and lower front faces of the second storage compartment 200 may form exterior surfaces of the refrigerator visible.

In one example, the first storage space 100*a* is communicably coupled with a front opening open forwardly of the refrigerator 10. The first storage space 100*a* may receive a plurality of shelves for loading food or other items stored in the first storage space 100*a* thereon.

Further, at one side of the front opening communicably coupled with the first storage space 100*a*, a door 300 may be configured to open and close the first storage space 100*a* (e.g., pivotably coupled) and to define a separate door receiving space defined therein separate from the first storage space 100*a*.

In this embodiment, the door 300 may include an inner door 320 to open and close the first storage space 100*a*, and having a home bar space defined therein as a separate receiving space, and an outer door 310 configured to open and close the receiving space of the inner door 320.

The outer door 310 and inner door 320 may have the same dimensions. For example, lengths of the outer door 310 and the inner door 320 may be the same and widths of the outer door 310 and the inner door 320 may be the same. Further, a plurality of door baskets or containers (not shown) may be arranged and spaced apart from each other in a vertical direction at a rear face of the outer door 310, that is, a face facing the inner door 320. Each door basket may be detachably coupled to the rear face of the outer door 310.

A rear edge of the outer door 310 may be surrounded by an outer door gasket 311. A latch 313 may be disposed at a rear edge at a side opposite to a side where a rotation shaft of the outer door 310 is disposed. The latch 313 may be disposed outside the outer door gasket 311.

In one example, on an outer face of the outer door 310, a manipulator 136 (controller) for controlling an operation state of the first storage compartment 100 and the second storage compartment 200 of the refrigerator 10 may be disposed. The manipulator 136 may include a button-type or touch-type input part. The manipulator 136 may be configured with buttons, a dome-shaped switch, a resistive/capacitive touch pad, a dial (jog wheel), jog switch (jog switch), the finger mouse, rotary switch, dial (jog dial), and other means to produce the input data by a specific operation such as pushing, rotating, pressing and contacting the like.

Further, a display 138 may be disposed on the outer face of the outer door 310 to indicate an operating state of the first storage compartment 100 and the second storage compartment 200. The display 138 is a light emitter (e.g. a light emitting diode (the LED), liquid crystal display (LCD) or organic electroluminescent (EL) display). The display 138 may receive a variety of manipulation signals for operating the refrigerator and displays information on the operation of the refrigerator to an external side.

In one example, the inner door 320 has an opening 321 of a predetermined size defined in a center region thereof. A receiving casing 400 is mounted as a rear face of the inner door 320. The opening 321 allows access to an interior of the receiving casing 400 when the inner door 320 is closed and the outer door 310 is opened.

In this embodiment, the outer door gasket 311 surrounding the back (rear) face of the outer door 310 is in close contact with a front face of the inner door 320. An outer edge of the opening 321 is surrounded with the outer door gasket 311. Therefore, when the outer door 310 is in close contact with the front face of the inner door 320, e.g., when the outer door 310 is closed, cold air leaking between the inner door 320 and the outer door 310 is blocked.

In one example, in the opening 321 of the inner door 320, a plurality of door baskets 312 may be disposed. The plurality of door baskets 312 may be arranged and spaced apart from each other at a predetermined spacing in a vertical direction in the inner door 320. Further, at each of both sides of the opening 321 of the inner door 320, there may be a fixed bracket 322 on which a door basket 312 is fixedly mounted and an ascending and descending bracket 323 on which a door basket 312 is mounted and which vertically moves.

In this embodiment, the ascending and descending bracket 323 may include a guide rail 324 fixed to each of both sides of the opening, and an ascending and descending portion 325 configured to be movable on the guide rail 324 and to support the door basket 312.

Further, a door dike 326 may protrude from an rear edge of the inner door 320. A front end of the receiving casing 400 may be coupled to the door dike 326. An inner door gasket 327 surrounds a rear edge of the inner door 320 corresponding to an outer side of the door dike 326.

Therefore, when the inner door 320 is in close contact with a front face of an outer casing 110, e.g., when the inner door 320 is closed, the inner door gasket 327 is in close contact with the front face of the outer casing 110 of the first storage compartment 100 such that cold air leakage from the first storage space 100*a* to the outside is blocked.

Further, a lock 328 may be disposed on a front face of the inner door 320, preferably, at a point thereof corresponding to the latch 313 when the outer door 310 is closed. When the outer door 310 comes into close contact with the front face of the inner door 320, the latch 313 is configured to engage with the lock 328, thereby allowing the outer door 310 to be maintained in a closed state.

Further, a door switch (not shown) may be disposed on a top or bottom of the front face of the inner door 320. The door switch may be disposed at a point away from a rotation shaft of the outer door 310 or at a point close to the rotation shaft. For example, when the outer door 310 is closed or opened, the door switch is manipulated, e.g., pressed down or raised up.

Hereinafter, the receiving casing will be described in detail with reference to the accompanying drawings.

Figure 5:
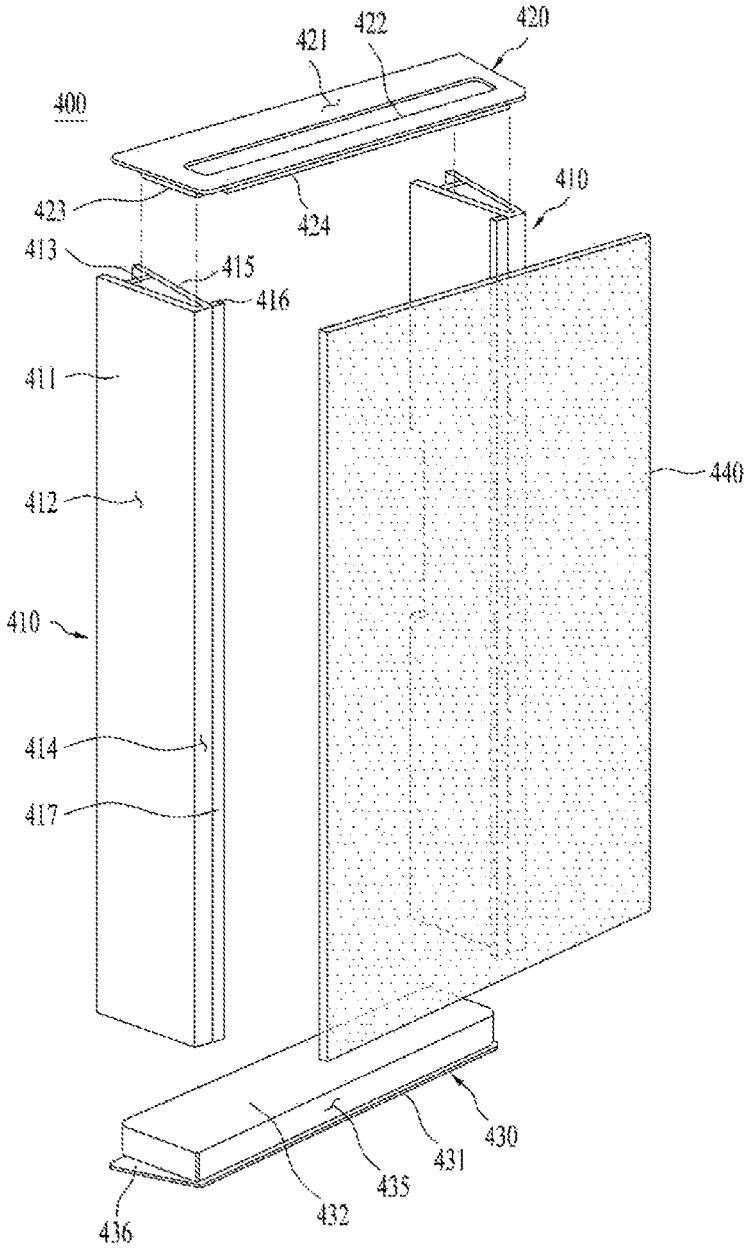
FIG. 5 is an exploded perspective view showing a receiving casing of a refrigerator according to an embodiment of the present disclosure.
Figure 6:
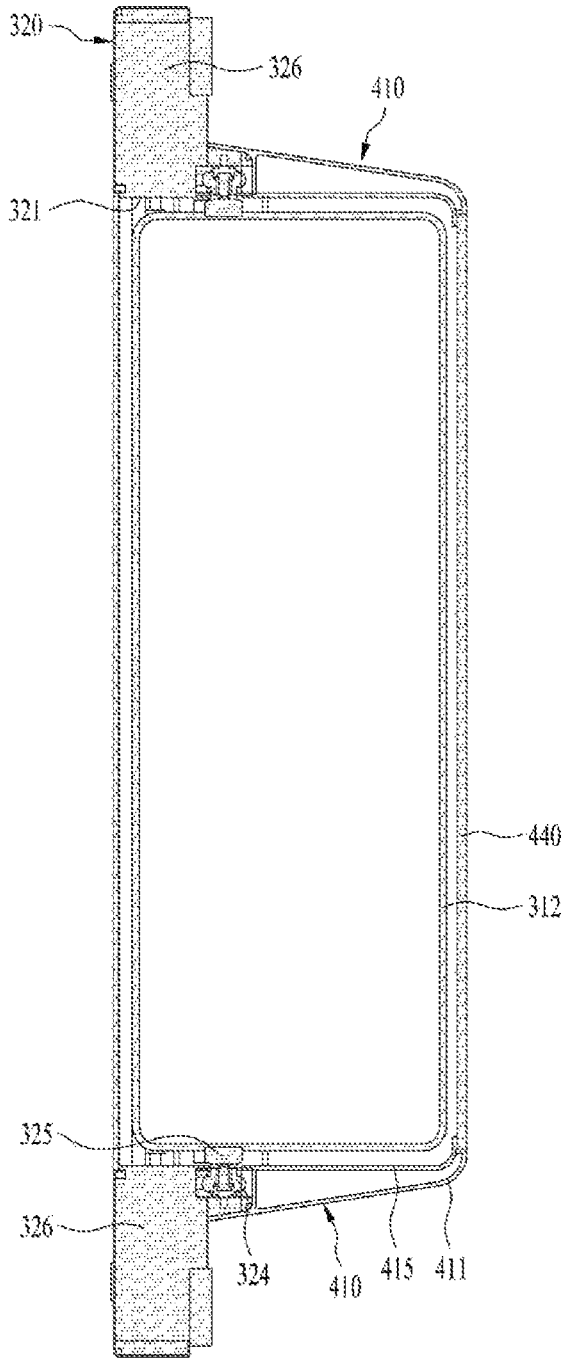
FIG. 6 is a transverse cross-sectional view showing an inner door of a refrigerator according to an embodiment of the present disclosure.
Figure 7:
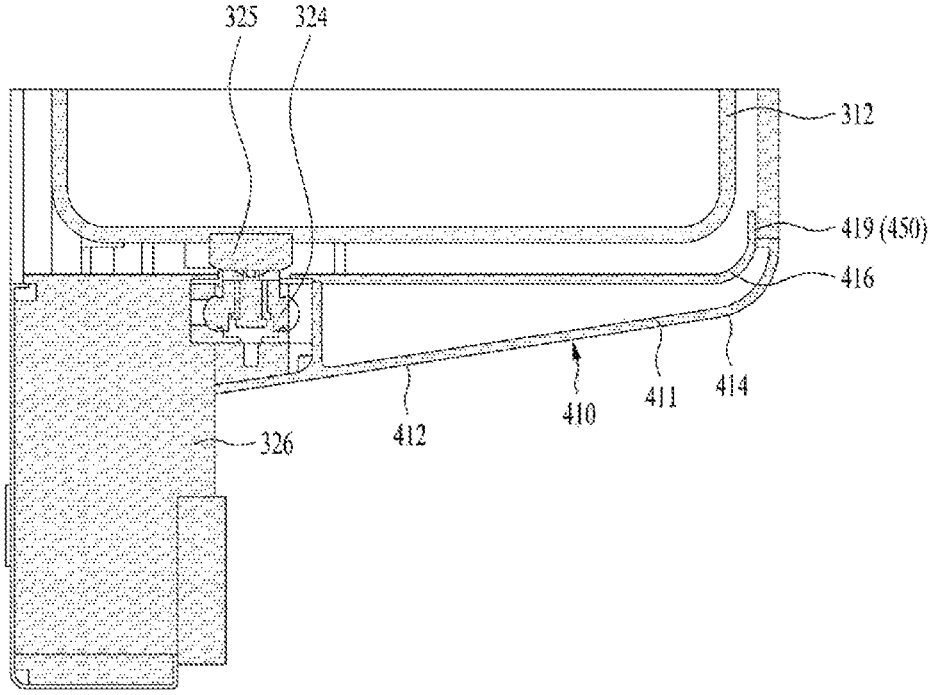
FIG. 7 is an enlarged cross-sectional view showing components of an inner door of a refrigerator according to an embodiment of the present disclosure.

FIG. 5 is an exploded perspective view showing the receiving casing of the refrigerator according to an embodiment of the present disclosure. FIG. 6 is a transverse cross-sectional view showing the inner door of the refrigerator according to an embodiment of the present disclosure.

As shown in exemplary FIGS. 5-6, the receiving casing 400 may be attached to the back (rear) face of the inner door 320 to form the receiving space of the inner door 320. The receiving casing 400 may be formed in a casing shape in which a face there facing the opening 321 is open such that the opening 321 formed in the inner door 320 is blocked by the rear face of the inner door 320.

In one example, the receiving casing 400 may include lateral frames 410 defining both sides of the receiving casing 400 respectively, an upper frame 420 attached to tops of the lateral frames 410, a lower frame 430 attached to bottoms of the lateral frames 410, and a transparent plate 440 of a transparent material attached to rear faces of the lateral frames 410, the upper frame 420, and the lower frame 430.

The lateral frames 410 may be respectively fitted onto both inner faces of the opening 321 of the inner door 320 to form both sides of the receiving casing 400. Each of the lateral frames 410 may include a hollow space 419 to thermally insulate the receiving casing 400. The both lateral frames 410 may be symmetrical with each other. In the description of the present disclosure, for convenience purposes, only one of the lateral frames 410 will be described as a representative one.

In one example, each of the lateral frames 410 may include an inner plate 415 defining an inner face of the receiving casing 400 and an outer plate 411 defining an outer face of the receiving casing 400 as shown in FIG. 5. In this embodiment, the hollow space 419 is disposed between the outer plate 411 and the inner plate 415 to form an adiabatic space.

Further, the outer plate 411 and the inner plate 415 may encounter with each other. Specifically, the outer plate 411 defining the outer face of the receiving casing 400 may extend in an inclined manner at a predetermined angle in a direction toward the inner door 320 defining the inner face of the receiving casing 400. In this case, the hollow space 419 disposed between the outer plate 411 and the inner plate 415 may have a triangular cross sectional shape (not limited thereto).

Further, a spacing rib 413 may extend between a first end of the outer plate 411, that is, an end opposite to an end encountering with the inner plate 415 and a corresponding first end of the inner plate 415 to space therebetween. The triangular hollow space 419 may be defined by the spacing rib 413 and the outer plate 411 and the inner plate 415.

In one example, a second end of the outer plate 411 opposite the first end has a curved portion 414 bent inwardly of the receiving casing 400 to smooth appearance of the receiving casing 400 and to join with the inner plate 415. A corresponding second end of the inner plate 415 has a bent portion 416 bent inwardly of the receiving casing 400 and corresponding to the curved portion 414 of the outer plate 411.

In this connection, the bent portion 416 of the inner plate 415 extends further beyond the curved portion 414 of the outer plate 411 in a direction toward the transparent plate 440. This further extension of the bent portion 416 has an adhered face 417 to which the transparent plate 440 is attached.

Thus, both edges of the transparent plate 440 may be attached and secured, via a separate adhesive member 450 (e.g., a double-sided tape, silicone), to both of the lateral adhered faces 417 of the lateral frames 410 forming the both sides of the receiving casing 400 respectively.

In one example, a top level of a distal end of the curved portion 414 of the outer plate 411 may be equal to or higher than (above) a top level of the transparent plate 440 attached to the lateral adhered faces 417. Therefore, the edges of both sides of the transparent plate 440 are respectively protected by the curved portions 414 of the outer plates 411 to prevent breakage of the transparent plate 440.

In this embodiment, for example, in each of the lateral frames 410 of the receiving casing 400, the outer plate 411 and the inner plate 415 are separate components. However, the present disclosure is not be limited thereto. The outer plate 411 and inner plate 415 may be integrally formed. That is, each of the lateral frames 410 may be manufactured by various manufacturing methods. The various manufacturing methods may form the hollow space 419 of each of the lateral frames 410.

Figure 8:
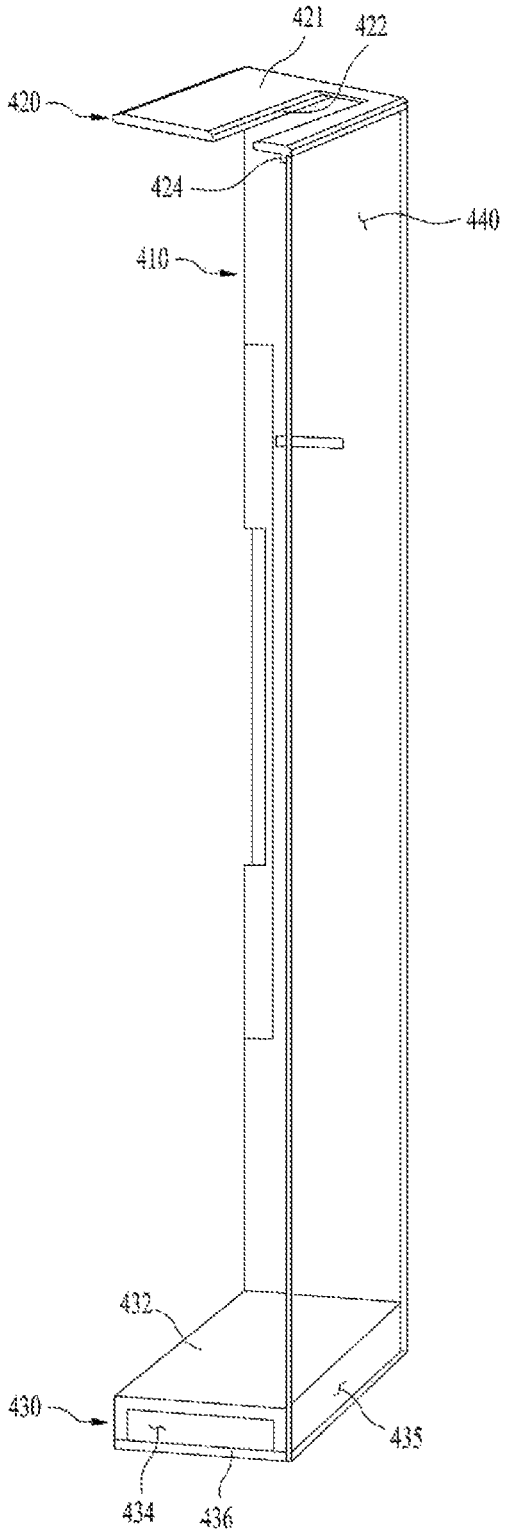
FIG. 8 is a longitudinal cross-sectional view showing the receiving casing of the refrigerator according to an embodiment of the present disclosure.

The upper frame 420 is fastened to the tops of the pair of spaced lateral frames 410 respectively defining the both sides of the receiving casing 400 such as shown in exemplary FIGS. 5 and 8 to form a top portion of the receiving casing 400. The upper frame 420 may include a plate-shaped upper plate 421 connecting the pair of the lateral frames 410 with each other. The shape of the upper plate 421 is not limited thereto.

In this embodiment, the upper plate 421 may have a cold-air hole 422 defined therein and extending in a length direction thereof for introduction of cold air residing in the first storage space 100*a* of the first storage compartment 100 into the receiving casing 400. The cold-air hole 422 may include a single elongate hole extending along a length of the upper plate 421 or may include a plurality of holes.

In one example, both inserted protrusions 423 may respectively protrude from both ends of a bottom face of the upper plate 421 and may be respectively inserted into the hollow spaces of the both lateral frames 410 defining the both sides of the receiving casing 400.

In this embodiment, the inserted protrusions 423 may be fixedly inserted into the hollow spaces 419 of the both lateral frames 410 respectively. To this end, each inserted protrusion 423 may have a shape corresponding to a shape of each hollow space 419 of each lateral frame 410.

Preferably, when the hollow space 419 disposed in each of the lateral frames 410 is formed into the triangular shape, each inserted protrusion 423 has a triangular cross section shape so as to be inserted into the triangular hollow space 419.

Further, an adhered portion 424 may protrude downwardly from a rear side of the bottom face of the upper plate 421. Thus, the adhered portion 424 may adhere to the lateral adhered portion 417 of the inner plate 415 of the lateral frames 410 and a top edge of the transparent plate, as shown in FIGS. 5 and 8.

Therefore, the top edge of the transparent plate 440 may be attached and secured to the adhered portion 424 formed on the bottom face of the upper frame 420 forming the top portion of the receiving casing 400 via a separate adhesive member 450, for example, a double-sided tape, silicone, or the like.

In one example, a top level of a longitudinal rear edge of the upper plate 421 may be equal to or higher than (above) a top level of the transparent plate 440 attached to the adhered portion 424. Therefore, the top edge of the transparent plate 440 is protected by the top edge of the upper plate 421 to prevent breakage of the transparent plate 440.

The lower frame 430 may be attached to the bottom surfaces of the both opposing lateral frames 410 respectively forming the both sides of the receiving casing 400 as shown in FIGS. 5 and 8 to form a bottom portion of the receiving casing 400. The lower frame 430 has a plate-shaped lower plate 431 connecting the pair of the lateral frames 410 with each other. The shape of the lower plate 431 is not limited thereto.

In this connection, a thermal insulating portion 432 may be disposed on a top face of the lower plate 431. The thermal insulating portion 432 may have an inner space 434 defined therein to insulate cold air introduced into the receiving casing 400. In this embodiment, the thermal insulating portion 432 has a length corresponding to a spacing between the opposite lateral frames 410 of the receiving casing 400. The inner faces of the lateral frames 410 may respectively contact and fixed to both outer sides of the thermal insulating portion 432.

In one example, the thermal insulating portion 432 has a lower adhered face 435 attached to the lateral adhered face 417 of the inner plate 415 and to a lower face of the transparent plate 440. The lower face of the transparent plate 440 may be attached and secured to the lower adhered face 435 of the thermal insulating portion 432 via a separate adhesive member 450, for example, a double-sided tape, silicone or the like.

In one example, a bottom level of a longitudinal rear edge of the lower plate 431 may be equal to or lower than (below) a bottom level of the transparent plate 440 attached to the lower adhered face 435 of the thermal insulating portion 432. Therefore, the lower edge of the transparent plate 440 is protected by the edge of the lower plate 431 to prevent breakage of the transparent plate 440.

The transparent plate 440 may be fixedly attached, via a separate adhesive member 450, to the lateral adhered face 417 of each of the lateral frames 410, the upper adhered face 424 of the upper frame 420, and the lower adhered face 435 of the lower frame 430.

The transparent plate 440 may be formed of a rectangular plate and made of a transparent material, and may be preferably made of a tempered glass material so that food or other items stored in the door basket 312 located inside the receiving casing 400 is visible to an user. The shape of the transparent plate 440 is not limited thereto.

A coating layer may be disposed on an outer periphery of the transparent plate where the transparent plate is attached to the lateral adhered face 417 of each of the lateral frames 410, the upper adhered face 424 of the upper frame 420 and the lower adhered face 435 of the lower frame 430. The coating layer 424 may increase the adhesive effect of the adhesive member 450 located between the transparent plate and each of the adhered faces 417, 424 and 435 and prevent the adhesive member 450 on each adhered face 417, 424 and 435 from being exposed to the outside through the transparent plate 440.

Although preferred embodiments have been depicted and described in detail herein, it will be apparent to those skilled in the relevant art that various modifications, additions, substitutions and the like can be made without departing from the spirit of the disclosure, and these are, therefore, considered to be within the scope of the disclosure, as defined in the following claims

What is claimed is:

1. A refrigerator comprising:

a first storage compartment comprising a first storage space defined therein;

an inner door to open and close the first storage space, wherein the inner door comprises an inner door receiving space defined therein;

a receiving casing attached to a rear face of the inner door to separate the first storage space from the inner door receiving space; and an outer door pivotally attached to the inner door to open and close the inner door receiving space, wherein the receiving casing comprises:

a frame surrounding the inner door receiving space, wherein the frame comprises a cold-air hole formed therein through which cold air from the first storage space may be introduced into the inner door receiving space; and a transparent plate attached to the frame to separate the inner door receiving space from the first storage space, wherein the frame includes:

a first lateral frame and a second lateral frame arranged in a symmetrical manner, wherein the inner door receiving space is defined between the first and second lateral frames;

a top frame coupled to a top surface of each of the first and second lateral frames, wherein the cold-air hole is formed in the top frame; and a bottom frame coupled to a bottom surface of each of the first and second lateral frames, wherein each of the first and second lateral frames comprises:

an outer plate defining an outer face of the respective first or second lateral frame; and an inner plate attached to the outer plate to define an inner face of the respective first or second lateral frame.

2. The refrigerator of claim 1, wherein the outer plate comprises a spacing rib to define a space between the inner plate and the outer plate.

3. The refrigerator of claim 1, wherein a hollow space for thermal insulation is defined between the outer plate and the inner plate.

4. The refrigerator of claim 1, wherein each of the first and second lateral frames extends further than a corresponding end surface of the outer plate to be attached to the transparent plate.

5. The refrigerator of claim 1, wherein the upper frame comprises protrusions protruding downwardly from both ends of a bottom face thereof, the protrusions configured to be inserted into the first and second lateral frames respectively.

6. The refrigerator of claim 1, wherein the upper frame comprises an adhered portion that protrudes from a bottom face thereof, the adhered portion configured to be attached to the transparent plate.

7. The refrigerator of claim 1, wherein a coating layer is disposed on the transparent plate along an outer perimeter thereof, the coating layer configured to prevent exposure of an adhesive member for attaching the transparent plate to the frame to an outside thereof.

8. The refrigerator of claim 1, wherein the outer door further comprises:

a manipulator for controlling an operation state of the first storage compartment; and a display for indicating an operation state of the first storage compartment.

9. The refrigerator of claim 1, wherein the lower frame comprises a lower plate to support the first and second lateral frames thereon.

10. The refrigerator of claim 9, wherein the lower frame further comprises a thermal insulating portion disposed on the lower plate and disposed between the first and second lateral frames.

11. The refrigerator of claim 1, wherein the refrigerator further comprises a second storage compartment located below the first storage compartment, wherein the second storage compartment comprises a second storage space defined therein.

12. The refrigerator of claim 11, wherein the second storage space operates independent of the first storage compartment.

13. The refrigerator of claim 11, wherein the second storage compartment comprises at least one drawer configured to extend outwardly from the second storage space to open the second storage space.

14. The refrigerator of claim 11, wherein the outer door further comprises:

a manipulator for controlling an operation state of the first storage compartment and the second storage compartment; and a display for indicating an operation state of the first storage compartment and the second storage compartment.

* * * * *